US006728501B2

(12) United States Patent
Sano

(10) Patent No.: US 6,728,501 B2
(45) Date of Patent: Apr. 27, 2004

(54) CHARGER AND PROCESS CARTRIDGE USING THE SAME

(75) Inventor: Junichi Sano, Yokosuka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/155,111

(22) Filed: May 28, 2002

(65) Prior Publication Data

US 2002/0181972 A1 Dec. 5, 2002

(30) Foreign Application Priority Data

May 25, 2001 (JP) ..... 2001-157178

(51) Int. Cl.[7] ..... G03G 15/02
(52) U.S. Cl. ..... 399/168
(58) Field of Search ..... 399/168, 169, 399/170, 171, 172, 173, 100, 115, 110, 111; 361/225, 229, 230, 233; 250/324, 325, 326

(56) References Cited

U.S. PATENT DOCUMENTS 5,485,252 A * 1/1996 Ishida et al. ..... 399/168
5,678,141 A * 10/1997 Asano et al. ..... 399/168
5,715,499 A * 2/1998 Yamazaki et al. ..... 399/169
5,842,087 A * 11/1998 Matsushita et al. ..... 399/174
6,214,651 B1 * 4/2001 Cox ..... 438/141
6,335,137 B1 1/2002 Suzuki et al.
6,337,957 B1 1/2002 Tamaki et al.
6,403,275 B1 6/2002 Kuramoto et al.
6,442,364 B2 8/2002 Kai et al.
6,468,706 B2 10/2002 Matsuda et al.
6,505,014 B2 1/2003 Aoki et al.
6,507,718 B2 1/2003 Ohjimi et al.

FOREIGN PATENT DOCUMENTS

JP 9-138543 5/1997
JP 11-327255 11/1999
JP 2002139889 A * 5/2002 ..... G03G/15/02
JP 2002351195 A * 12/2002 ..... G03G/15/02

OTHER PUBLICATIONS

Kern George; Clean and hydrogenated diamond and garphite surfaces; Sep. 1998; Technical University of Vienna.*

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A charger includes a charging member for charging a desired member. The charging member is made up of a conductive support and a film formed on the support and formed of a substance having negative electron affinity. The film affects electrostatic electron discharge at a low voltage and can therefore charge the desired member more efficiently than a substance having electron affinity. In addition, the charger does not affect discharge and therefore reduces ozone.

33 Claims, 4 Drawing Sheets

CHARGER AND PROCESS CARTRIDGE USING THE SAME

BACKGROUND OF THE INVENTION

1. Field of the Invention

The present invention relates to a copier, laser printer, facsimile apparatus or similar image forming apparatus. More particularly, the present invention relates to a charge for charging a desired member in the vicinity of the member and a process cartridge using the same.

2. Description of the Background Art

It is a common practice with an image forming apparatus to charge a photoconductive element or image carrier with either one of a contact type charger and a non-contact type charger. A corona charger, for example, is a typical non-contact type charger and implemented as a corotron charger or a scorotron charger. The corona charger effects corona discharge by being applied with a voltage as high as 5 kV to 10 kV. A problem with the corona charger is that impurities deposit on the electrode of the charger due to the high voltage and discharge. Another problem is that sputtering and oxidation ascribable to the collision of active substances, which are produced by ionization, deteriorate the electrode of the charger, thereby producing ozone. Ozone is hazardous to the human body and environment and deteriorates various parts arranged in the image forming apparatus. Further, ozone and nitrogen oxides ascribable to the discharge deposit on the photoconductive element, bringing about irregular images and other defective images.

The contact type charger is generally implemented as a charge roller. While a charge roller also effects corona discharge, discharge is confined in a gap as small as 100 $\mu$m or less and reduces the amount of ozone and other active substances to about one-tenth of the amount particular to the corona charger. However, it is likely that smears on the photoconductive element are transferred to the charge-roller, which is held in contact with the photoconductive element. The smears and scratches ascribable thereto are apt to make charging defective, causing white stripes and other defects to appear in an image.

Japanese Patent Laid-Open Publication No. 8-272,194, for example, teaches a proximity type charging system for obviating defective charging. The proximity type charging system uses a charging member including a conductive support formed of metal or an insulator coated with metal or conductive paint. The support is covered with a resistance layer implemented by polypropylene, polyethylene or similar resin or silicone rubber or similar rubber in which a conductive filler is dispersed. For the conductive filler, use is made of titanium oxide, carbon powder or metal powder by way of example. An AC bias is applied to the charging member for thereby effecting proximity type of charging. Further, a plurality of charging members are arranged around a photoconductive drum to thereby enhance efficient charging. However, even the proximity type charging system cannot fully obviate ozone.

Technologies relating to the present invention are also disclosed in, e.g., Japanese Patent Laid-Open Publication Nos. 9-138543 and 11-327255.

SUMMARY OF THE INVENTION

It is an object of the present invention to provide a charger capable increasing charging efficiency to thereby reduce required energy as well as ozone and achieving a long life by effecting non-discharge, non-contact type of charging, and a process cartridge using the same.

A charger of the present invention includes a charging member for charging a desired member. The charging member is made up of a conductive support and a film formed on the support and formed of a substance having negative electron affinity (i.e., is not attracted to electrons).

A process cartridge using the above charger is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
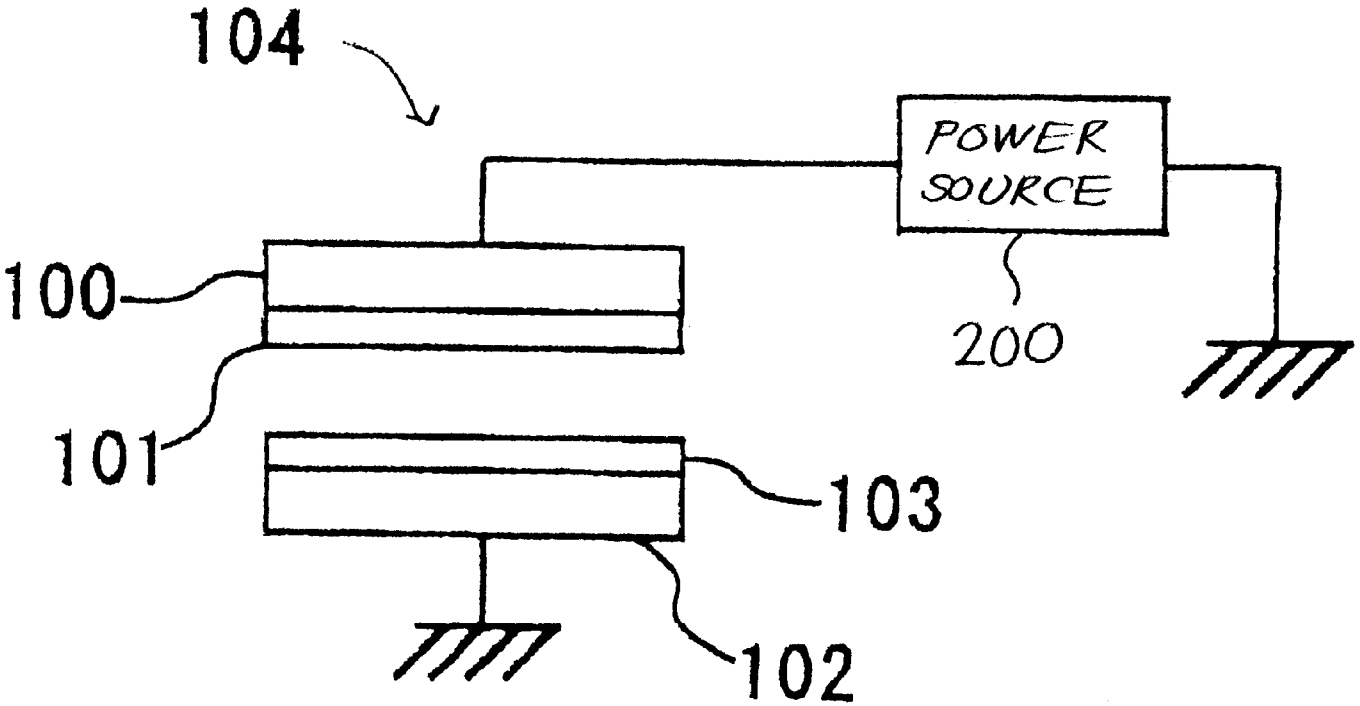
FIG. 1 shows a charger embodying the present invention.

Referring to FIG. 1 of the drawings, a charger embodying the present invention is shown and generally designated by the reference numeral 104. As shown, the charger 104 includes a conductive support 100 on which a film 101 is formed by use of a substance having negative electron affinity. A power source 200 is connected to the support 100. The charger 104 is spaced from a member 103 to be charged, which is positioned on an electrode 102 facing the charger 104. A substance having a high dielectric constant and easy to hold charge is feasible for the member 103.

A voltage applied from the power source 200 to the support 100 acts on the film 101 having negative electron affinity. When energy (electric field) greater than the sum of the energy gap of the film 101 and air barrier present at the interface is applied to the film 101, the film 101 discharges electrons. Such electrons reach the electrode 102 due to the intense electric field for thereby charging the member 103.

Basically, the support 100 may be formed of any suitable material so long as it is connectable to the film 101 by Ohmic connection. To obviate potential drop as far as possible, the material of the support 100 should preferably have low electric resistance.

Regarding the energy state of a substance, the negative electron affinity refers to a condition wherein the vacuum level is lower than the conduction band level. When energy corresponding to the energy gap of a substance with such negative electron affinity is applied to the substance, electrons reach the vacuum level and are discharged from the substance more easily than from a substance having electron affinity. It follows that the charger 104 with the film 101 formed on the support 100 can charge the member 103 by electrostatic electron discharge under the application of a low voltage. The charger 104 therefore does not effect discharge and can reduce ozone.

The substance with negative electron affinity may be produced by any one of conventional, thin film forming methods including CVD (Chemical Vapor Deposition) using glow discharge, sputtering, thermal CVD, optical CVD, ion beam deposition, and laser abrasion. DLC (Diamond Like Carbon), which is close in property to diamond, is a typical substance having negative electron affinity. DLC is superior to silicon (Si) and metals as an electron discharging material in the aspect of hardness, chemical inactiveness, heat conduction, electron discharging characteristic, and stability of discharge.

To form a DLC film, it is preferable to use high-frequency plasma CVD capable of varying a ratio of $sp^2$ and $sp^3$ components in terms of pressure and carbon composition ratio under a pressure as low as 133 Pa (1 Torr) or below. Further, a DLC film can be formed by a low-cost film forming apparatus and formed of an inexpensive material. This, coupled with the fact that a DLC film can have its properties freely controlled close to those of graphite or diamond, extends the application of the CLD film even to electrostatic discharge display and wear resistance coating. The charger 104 is therefore low cost and can charge the member 103 by electrostatic electron discharge under the application of a low voltage. The absence of discharge is successful to reduce ozone.

Figure 2A:
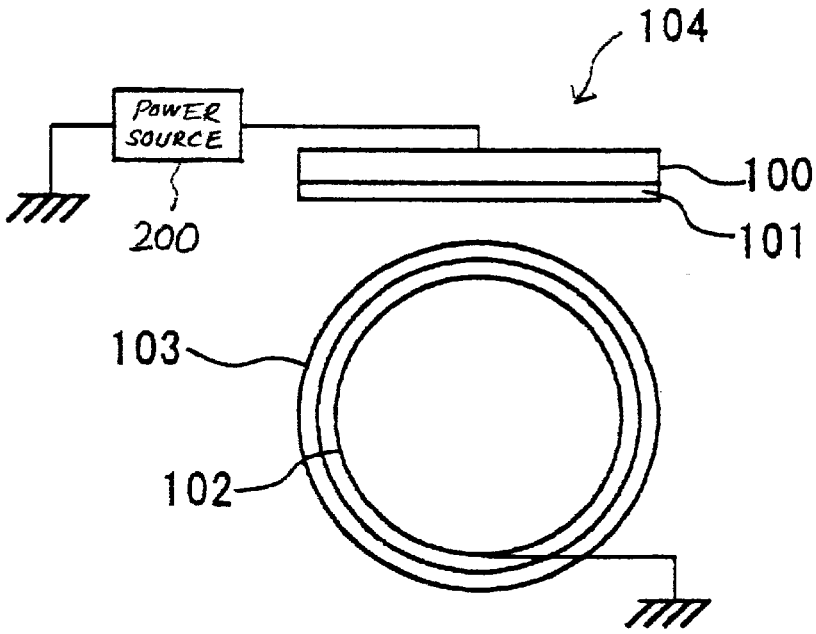
FIGS. 2A and 2B each show a particular alternative embodiment of the present invention.
Figure 2B:
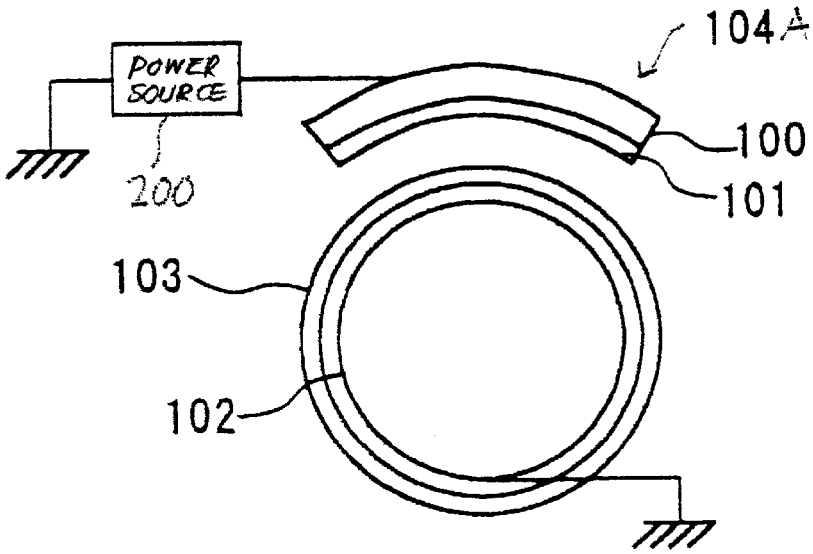

FIGS. 2A and 2B each show a particular alternative embodiment of the present invention. As shown in FIG. 2A, the charger 104 is identical in configuration with the charger 104 of FIG. 1 while the member 103 is provided with curvature. In this configuration, an electric field concentrates on the position where the distance between the charger 104 and the member 103 is smallest. Electron discharge occurs only at such a position and therefore lacks efficiency. FIG. 2B shows a charger 104A provided with curvature such that the distance between the charger 104A and the member 103 is uniform. This configuration causes electron discharge to occur over the entire gap between the charger 104A and the member 103. Such electron discharge enhances charging efficiency and thereby reduces energy necessary for charging as far as possible.

Figure 3:
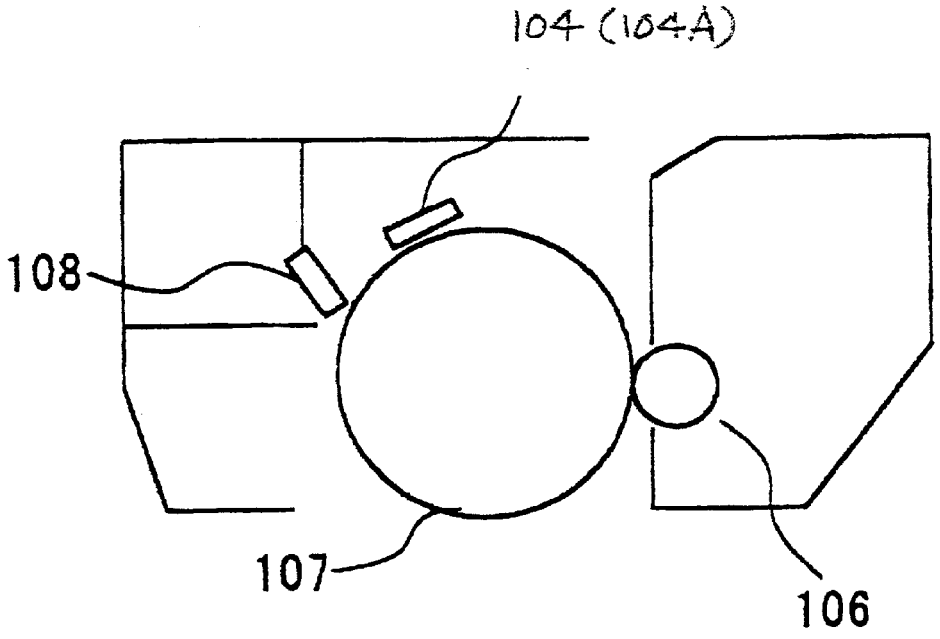
FIG. 3 shows a process cartridge including the charger of the present invention together with other process means for image formation.

FIG. 3 shows a specific configuration of a process cartridge removably mounted to an image forming apparatus and including the charger 104 or 104A as charging means. As shown, the process cartridge includes a developing device 106, a photoconductive drum 107 and a cleaning device 108 in addition to the charger 104 or 104A.

In operation, while the drum 107 is rotated at a preselected peripheral speed, the charger 104 or 104A uniformly charges the surface of the drum 107 to positive polarity or negative polarity. An exposing unit, not shown, exposes the charged surface of the drum 107 imagewise via a slit or with a laser beam to thereby form a latent image on the drum 107. The developing device 106 develops the latent image with toner for thereby forming a corresponding toner image. An image transferring device transfers the toner image from the drum 107 to a sheet or recording medium, which is conveyed from a sheet feeder to a position between the transferring device and the drum 107 in synchronism with the rotation of the drum 107. The sheet with the toner image is peeled off the drum 107 and conveyed to a fixing device. After the fixing device has fixed the toner image on the sheet, the sheet or print is driven out of the image forming apparatus. After the image transfer, a drum cleaner 108 removes toner left on the drum 107 to prepare it for the next image formation.

To grasp the characteristics of substances having negative electron affinity, experiments were conducted to determine the electron discharge characteristics of DLC and mirror-plane n-type silicon. To form-films, use was made of high-frequency plasma CVD and a material implemented as a methane and hydrogen mixture gas. Each film was formed on an aluminum support to a thickness of about 1 $\mu$m.

Figure 4:
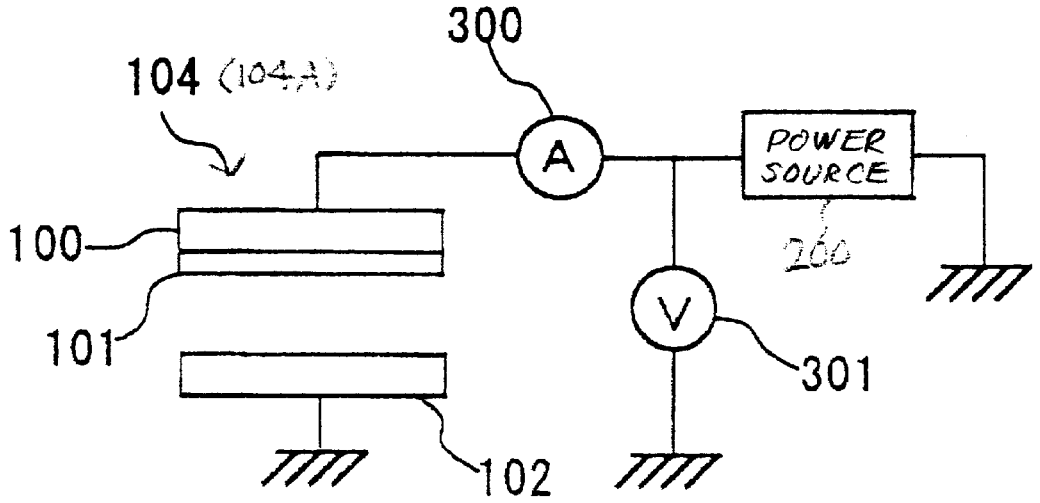
FIG. 4 is a block diagram schematically showing a specific device for examining an electron discharge characteristic.

FIG. 4 shows a specific arrangement used to examine the electron discharge characteristics and including an ammeter 300 and a voltmeter 301. A relation between an electron discharge current and a DC voltage applied was determined. The charger 104 or 104A and a member 102 to be charged were spaced from each other by about 200 $\mu$m. A negative voltage was applied to the charger 104 at the atmospheric pressure.

Figure 5:
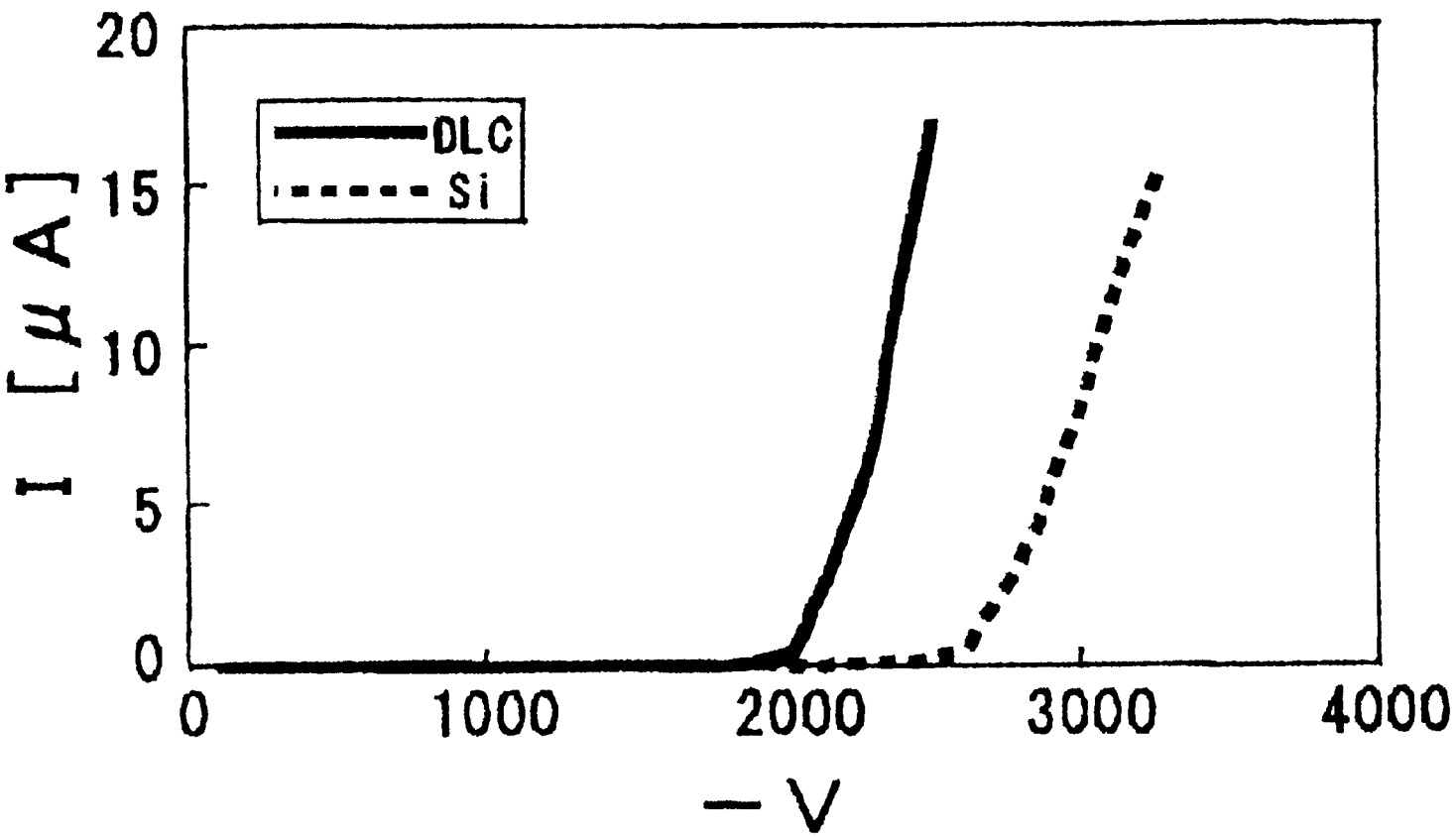
FIG. 5 is a graph showing a relation between an electron discharge current and a DC voltage.

FIG. 5 shows a relation between the electron discharge current and the DC voltage determine by the experiments. As shown, DLC affected electrostatic electron discharge at a lower voltage than silicon. This proves that a substance having negative electron affinity is desirable for electrostatic electron discharge.

Whether or not the member 102 was charged was determined with the charger 104 or 104A and member 102 arranged as shown in FIG. 1. The member 102 was implemented as an insulative, polyethylene film. The distance between the charger 104 or 104A and the member 102 was selected to be 100 $\mu$m while the DC voltage was selected to be −2 kV. It was found with a surface electrometer that after charging a charge of about −0.5 kV was held on the surface of the member 102.

How the configuration of the charger effects the charging characteristic was determined with the member 103 having curvature. The flat charger 104, FIG. 2A, and curved charger 104A, FIG. 2B, were used for comparison. The chargers 104 and 104A had the same surface area. The member 103 was implemented as an organic photoconductor having a diameter of 30 mm. Measurement showed that the curved charger 104A uniformly spaced from the member 103 effected uniform electrostatic electron discharge and therefore discharged more electrons than the flat charger 104. The charger 104A increased the current by about 50% at the beginning of discharge.

In summary, it will be seen that the present invention provides a charger and a process cartridge having various unprecedented advantages, as enumerated below.

(1) A film is formed on a conductive support by use of a substance having negative electron affinity. The film affects electrostatic electron discharge at a low voltage and can therefore charge a desired member more efficiently than a substance having electron affinity. In addition, the charger does not affect discharge and therefore reduces ozone.

(2) The charger charges the member without contacting the member and is therefore free from wear and may have a long life.

(3) When the charger is so curved as to be spaced from a curved member by a uniform distance, the charger affects electrostatic electron discharge over its entire area and is therefore highly efficient.

(4) DLC, which is a specific form of the above-stated substance, makes the charger low cost and high quality.

(5) The process cartridge using such a charger is highly durable and has no influence on environment.

Various modifications will become possible for those skilled in the art after receiving the teachings of the present disclosure without departing from the scope thereof.

What is claimed is:

1. In a charger comprising a charging member for charging a desired member, said charging member comprises a conductive support and a film formed on said conductive support and formed of a substance having a vacuum level lower than a conduction band level, wherein said charging member is positioned such that said charging member does not contact said desired member.

2. The charger as claimed in claim 1, wherein the substance comprises DLC (Diamond Like Carbon).

3. The charger as claimed in claim 1, wherein said charging member is curved such that a distance between said charging member and the desired member is uniform.

4. The charger as claimed in claim 3, wherein the substance comprises DLC (Diamond Like Carbon).

5. The charger as claimed in claim 1, wherein said charging member is spaced from the desired member.

6. The charger as claimed in claim 5, wherein the substance comprises DLC (Diamond Like Carbon).

7. The charger as claimed in claim 5, wherein said charging member is curved such that a distance between said charging member and the desired member is uniform.

8. The charger as claimed in claim 7, wherein the substance comprises DLC (Diamond Like Carbon).

9. The charger as claimed in claim 1, wherein the film is formed on a surface of said support facing a surface of the desired member.

10. In a process cartridge comprising at least one of a photoconductive element, charging means, developing means and cleaning means and removably mounted to an image forming apparatus, said charging means comprises a charging member for charging a desired member, said charging member comprising a conductive support and a film formed on said support and formed of a substance having a vacuum level lower than a conduction band level, wherein said charging member is positioned such that said charging member does not contact said desired member.

11. The charger as claimed in claim 10, wherein the substance comprises DLC (Diamond Like Carbon).

12. The charger as claimed in claim 10, wherein said charging member is curved such that a distance between said charging member and the desired member is uniform.

13. The charger as claimed in claim 12, wherein the substance comprises DLC (Diamond Like Carbon).

14. The charger as claimed in claim 10, wherein said charging member is spaced from the desired member.

15. The charger as claimed in claim 14, wherein the substance comprises DLC (Diamond Like Carbon).

16. The charger as claimed in claim 14, wherein said charging member is curved such that a distance between said charging member and the desired member is uniform.

17. The charger as claimed in claims 16, wherein the substance comprises DLC (Diamond Like Carbon).

18. A charger, comprising:

a charging member for charging a desired member, comprising, a conductive support, and a film formed on the conductive support, wherein the film has a vacuum level lower than a conduction band level, the charging member is positioned such that the charging member does not contact the desired member, and the film is formed on a surface of the conductive support facing a surface of the desired member.

19. The charger as claimed in claim 18, wherein the film includes DLC (Diamond Like Carbon).

20. The charger as claimed in claim 18, wherein the charging member is curved such that a distance between the charging member and the desired member is uniform.

21. The charger as claimed in claim 20, wherein the film includes DLC (Diamond Like Carbon).

22. The charger as claimed in claim 18, wherein the charging member is spaced from the desired member.

23. The charger as claimed in claim 22, wherein the film includes DLC (Diamond Like Carbon).

24. The charger as claimed in claim 22, wherein the charging member is curved such that a distance between the charging member and the desired member is uniform.

25. The charger as claimed in claim 24, wherein the film includes DLC (Diamond Like Carbon).

26. A process cartridge, comprising:

a photoconductive element;

charging means for charging a desired member;

developing means; and cleaning means, wherein the process cartridge is configured to be removably mounted to an image forming apparatus, wherein the charging means includes a charging member, and wherein the charging member comprises a conductive support and a film formed on the support, the film having a vacuum level lower than a conductive band level, wherein the charging member is positioned such that the charging member does not contact the desired member.

27. The charger as claimed in claim 26, wherein the film includes DLC (Diamond Like Carbon).

28. The charger as claimed in claim 26, wherein the charging member is curved such that a distance between the charging member and the desired member is uniform.

29. The charger as claimed in claim 28, wherein the film includes DLC (Diamond Like Carbon).

30. The charger as claimed in claim 26, wherein the charging member is spaced from the desired member.

31. The charger as claimed in claim 30, wherein the film includes DLC (Diamond Like Carbon).

32. The charger as claimed in claim 30, wherein the charging member is curved such that a distance between the charging member and the desired member is uniform.

33. The charger as claimed in claim 32, wherein the film includes DLC (Diamond Like Carbon).

* * * * *